United States Patent [19]

Collins et al.

[11] 4,111,353

[45] Sep. 5, 1978

[54] PARTITIONED TRAY AND MULTIPLE TRAY CONTAINER

[75] Inventors: Steven Collins, Lauderhill; A. Wayne Fausett, Miami, both of Fla.

[73] Assignee: Alton Box Board Company, Alton, Ill.

[21] Appl. No.: 805,720

[22] Filed: Jun. 13, 1977

[51] Int. Cl.[2] ..... B65D 5/26; B65D 5/22; B65D 5/48

[52] U.S. Cl. ..... 229/34 R; 229/42; 229/15

[58] Field of Search ..... 206/499; 229/34 R, 37 R, 229/42, 15 R

[56] References Cited

U.S. PATENT DOCUMENTS

| | | | |
|---|---|---|---|
| 2,587,706 | 3/1952 | Deline | 229/15 R |
| 2,707,587 | 5/1955 | Wittstein | 229/34 R |
| 3,252,648 | 5/1966 | Johnson | 229/34 R |
| 3,398,000 | 8/1968 | Peters | 229/42 |

*Primary Examiner*—William T. Dixson, Jr.
*Attorney, Agent, or Firm*—Paul M. Denk

[57] ABSTRACT

A partitioned tray, formed having a bottom wall, side walls, and end walls, are folded into a tray configuration, having an opened top, with a series of both laterally and longitudinally arranged partitions contained within the tray extending upwardly from its bottom wall. The ends of each side wall incorporate foldable tabs therewith, with said tabs arranged for disposition intermediate a pair of foldably connected panels forming each of the tray end walls. One panel of each double panel end wall is foldably connected to the end edge of the bottom wall, while the other panel of the double panel end wall secures to an aperture or slot provided in the bottom wall for retention of the end and side walls into the tray configuration. A plurality of such trays are stackable, one upon the other, and insertable within a container, as for storage or shipment.

15 Claims, 5 Drawing Figures

PARTITIONED TRAY AND MULTIPLE TRAY CONTAINER

BACKGROUND OF THE INVENTION

This invention relates generally to a container, and more specifically pertains to the packaging and shipment of stackable trays laden with food or other items.

Various style of interlocking boxes are readily available in the art, having tray configurations, and usually such formed containers are provided for furnishing supplemental benefits in the category of a dispenser after it arrives at its location of marketing. For example, in Michiele U.S. Pat. No. 2,937,742, a dispensing tray is readily shown and which has the configuration of an open tray, with a divider therein, for purposes of dispensing merchandise at the store. Another such prior art type of compartmentalized tray is shown in Holoubek U.S. Pat. No. 2,073,635, and which generally discloses a flexible tray which is foldable from a one piece blank of material, and which can be used for securing various comestibles during their storage, exposure for sale, transportation to the home, and during usage. In addition, the patent to Bellerive, U.S. Pat. No. 3,092,297, shows a complex form of divider or partition means for a tray, and which is essentially used during portion control packaging and marketing of food items, such as candy, or the like. Finally, the patent to Jones, U.S. Pat. No. 2,914,235, discloses a foldable interlocked box, and which box is formed into an open configuration, having a separate lateral divider provided therein. This box finds its utility in its interlocking features that secure various panels together to form the box into compartments, and for use in holding a variety of items.

The current invention, on the other hand, provides an improvement over the type of interlocking boxes shown in the prior art, and provides for a much more convenient and easily partitionable carton or tray from a unitized blank of paperboard or other carton material, which trays are then stackable after being laden with food or other materials, and locateable within a container for shipment and use at a remote location.

It is, therefore, the principal object of this invention to provide a stackable tray configuration that may be laden with a variety of packaged items and inserted within an enclosing container for shipment, storage, or marketing.

Another object of this invention is to provide an individual tray formed of paperboard or other material and which tray includes a series of longitudinally and laterally disposed dividers that are formed from the unitized blank as initially die cut to the initial tray configuration.

Another object of this invention is to provide means for securing the various side and end walls of a foldable tray together through the use of integral connecting means, obivating the use of any supplemental fasteners to secure and retain the tray in its useable configuration.

Another object of this invention is to provide a divided tray wherein certain of its partitions are formed integrally from the bottom wall of the tray blank.

Another object of this invention is to provide a one piece blank for a partitionable tray.

These and other objects will become more apparent to those skilled in the art upon reviewing the summary of this invention, and upon undertaking a study of the description of the preferred embodiment in view of its drawings.

SUMMARY OF THE INVENTION

This invention includes a particularly designed stackable tray that when associated with trays of a like makeup, can be inserted within a master pack or container for shipping purposes. The master container has the usual carton configuration, and is designed for snugly embracing a plurality of the trays after each is laden with other packaged items.

Each tray is preferably formed from a unitary blank of material, and in the blank form, the intended tray includes a bottom wall segment, side wall segments, and end wall segments. These segments, when folded over into an operating position, form the side walls, end walls, and the bottom for the open tray. Each end wall is formed from a pair of foldably connected panels, with the outer panel being connected with the end edge of the bottom panel, and with the inner panel folding over and includes extensions that insert within apertures, or other locking means, provided proximate the end edge of the bottom wall of the tray. The side walls, on the other hand, include extending tabs, which insert intermediate the double paneled end wall, at each end of the tray, and which thereby provides for a retention of the side walls, within the end walls, and a fixation of the tray into its useable configuration.

The bottom wall is formed having precut sections that when folded upwardly, form lateral partitions of the tray, and another partition, in the tray blank form, is releasably secured to the end of the tray blank, and once severed therefrom, cooperates with the laterally disposed partitions for forming a longitudinal partition that centrally divides the tray along its length. Thus, in its completed configuration, the tray of the preferred embodiment is formed into six spaced areas, with each area provided for accommodating another packaged item, such as a packaged frozen food item, or the like, for shipment, display, or sale as desired.

DESCRIPTION OF THE PREFERRED EMBODIMENT

Figure 1:
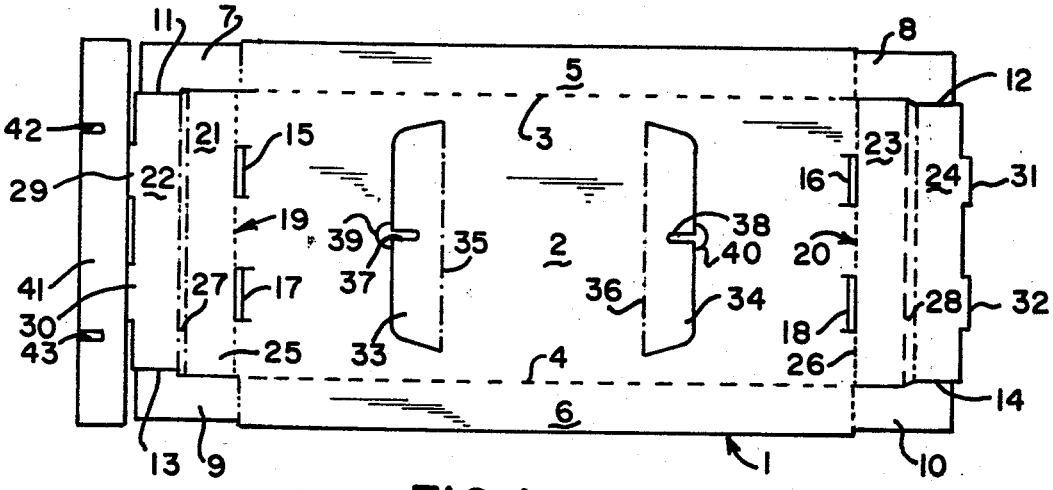
FIG. 1 provides a plan view of a blank for the tray of this invention.

In referring to the drawings, and in particular FIG. 1, there is disclosed a unitized blank for the tray segment of this invention. This blank 1, comprises a bottom wall segment 2 that has foldably connected to its sides, as along the fold lines 3 and 4, respectively, the side wall segments 5 and 6. Projecting foldably from the ends of each side wall segment are the integrally foldable tabs 7 through 10. These tabs extend for some distance, and when folded over, approximately 90°, can be arranged approximately parallel with the intended end walls of the tray, when folded into its useable configuration, with the bottom of the tabs having slightly projecting edges 11 through 14 partially inserted into the slots 15 through 18, respectively, to provide a minor inner engaging relationship between these side wall tabs 7 through 10, and the bottom wall 2.

Foldably connecting at each end of the bottom wall segment 2 are the blank end wall segments 19 and 20. Each of these end wall segments are formed having a pair of foldably connected panels, as at 21 through 24, with the first panels 21 and 23, of each end wall segment, being foldably connected along their respective fold lines 25 and 26 with the end edges of the bottom are foldably connected with their associated and eventually interiorly tray disposed panels 22 and 24, respectively, as shown. There may be provided intermediate each of the double panel end walls a spacer panel, with the spacer panel 27 shown as disposed intermediately between the panels 21 and 22, while the spacer panel 28 is arranged intermediately the end wall panels 23 and 24. Extending exteriorly of the outer edges of the intended interior panels 22 and 24 are the extensions 29 through 32, and when these paired double panels forming their respective end walls of the tray are folded into their operative position, these extensions 29 through 32 are insertable within their aligned slots 15 through 18, as previously defined as formed proximate the end edges of the bottom wall segment 2, so as to lock the tray into its operative disposition. It is to be noted that the end wall panels 22 and 24 are slightly less in width than the intended exterior end wall panels 22and 24 to be inserted within the interior of the tray, as when it is folded into position.

This tray also contemplates the integral formation of various partitions within its interior and useable space, and as can be seen also from FIG. 1, in the blank form, there are a pair of intended laterally disposed partitions formed within the bottom wall of the tray. These partitions 33 and 34 are cut around their periphery from the bottom wall segment 2 of the tray blank, but with one edge of their intended partition, generally their lower edge, being yet foldably connected, as along the fold lines 35 and 36, respectively, to the bottom wall segment 2. Thus, when these partitions 33 and 34 are folded 90° upwardly, they are yet foldably connected to the bottom wall 2 of the tray, but become disposed upwardly into a divider like operative disposition. Each of these partitions 33 and 34 contains a partial slot, as at 37 and 38, respectively, cut into their upper edges, and the bottom wall segment 2 has a finger slot, as at 39 and 40, respectively, disposed in alignment with the aforesaid partition slots 37 and 38, so as to provide clearance for the finger, or other machine instrumentality, to be inserted therein so as to attain the upward elevation of the said partitions 33 and 34 into their erect position.

Removably connected at one end of the unitized tray blank 1 is an intended longitudinal partition 41, which when readied for usage, is severed from the extensions 29 and 30 of the end wall panel 32. This partition also includes a pair of partial slots 42 and 43 cut therein, and these particular partial slots are intended to become arranged in alignment with the slots 37 and 38 of the lateral partitions 33 and 34, to matingly engage therewith, so as to form a totally partitioned and divided tray, which in this particular instance, as shown in this embodiment, will form six spaced areas for the tray.

It may be commented that it is within the province of this invention that the longitudinal partition 41 may be formed from the bottom wall 2, while the lateral partitions 33 and 34 may be formed removably connected with the panels 22 and 24 in the blank form.

Figure 2:
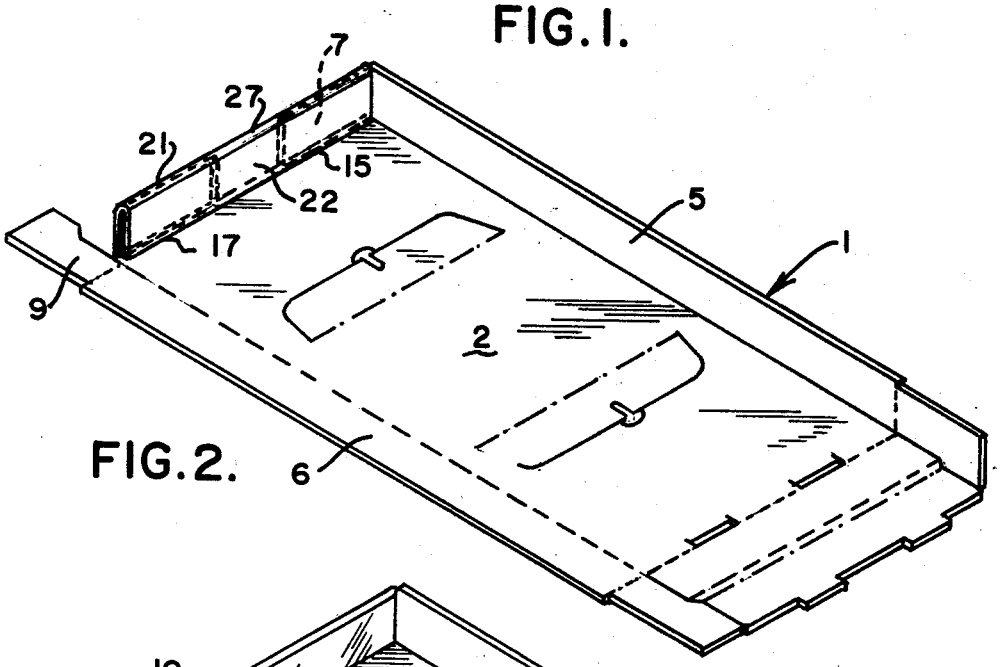
FIG. 2 provides an isometric view of a partially folded tray, being formed from the blank of FIG. 1.

In the assembly of this tray, and referring to FIG. 2, it can be seen that the bottom wall 2 is at rest upon a surface, and the side walls are then folded upwardly approximately at a right angle with respect to the bottom wall. In this particular instance, the side wall 5 is shown at its assembled stage. The tab 7, provided at one end of the side wall 5 is also folded perpendicularly, and is arranged intermediate the outer end wall panel 21, which has been bent upwardly, and its attached inner end wall panel 22. The extensions 29 and 30 of the end wall panel 22 are inserted within the slots 15 and 17, respectively, as formed through the bottom wall 2. Thus, the side wall tab 7 is locked into position intermediate the double paneled end wall 19, and thereby secures this segment of the tray into its operative configuration. Obviously, before the end wall panel 22 is folded over, the tab 9 of the side wall 6 will have already been folded into its operative position, with the side wall 6 being erected, and the tab 9 extending intermediate the two end wall panels 21 and 22, as aforesaid. The partial projections 11 and 13, of the tabs 7 and 9, respectively, will also seat conveniently within the slots 15 and 17, respectively, so as to insure a snug locking engagement of these tabs, and their respective side walls 5 and 6, into the tray configuration. And, as previously described, the intermediate panel 27 of the double paneled end wall 19 provides sufficient space intermediate the two end wall panels 21 and 22, so as to furnish clearance for the tabs 7 and 9 when arranged intermediate the same.

Figure 3:
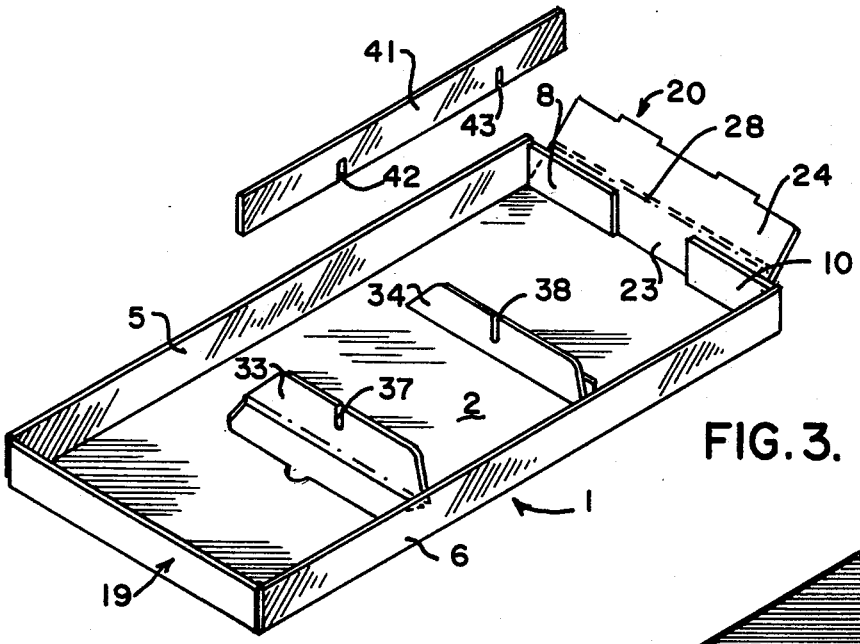
FIG. 3 provides an isometric view of a tray during its final assembly and partitioning location.

As can be seen from FIG. 3, a further stage in the assembly of the tray 1 is achieved. In this position, the end wall 19 has been assembled with respect to the side walls 5 and 6, and the tabs 8 and 10, integrally folded to the ends of the side walls 5 and 6, are also bent inwardly approximately 90°, and arranged at a position whereby the panel 23 is folded upwardly into contiguity with said tabs, and eventually its foldably connected intermediate panels 28 and 24 will be folded over, and undertake a locking engagement around the said side wall tabs 8 and 10 so as to secure the end panel 20, also into its operative position.

As can also been seen from FIG. 3, the laterally extending partitions 33 and 34 have also been bent upwardly approximately 90°, and maintain an erected position within the interior of the tray. The intended longitudinal partition 41 will have already previously been severed from its connection with the end wall panel 22, and it is then aligned above the lateral partitions 33 and 34, and then lowered so that their respective slots 37 and 42, and 38 and 43 can be interengaged, thereby providing inherent structure for maintaining the standing disposition of these partitions within the assembled tray.

Figure 4:
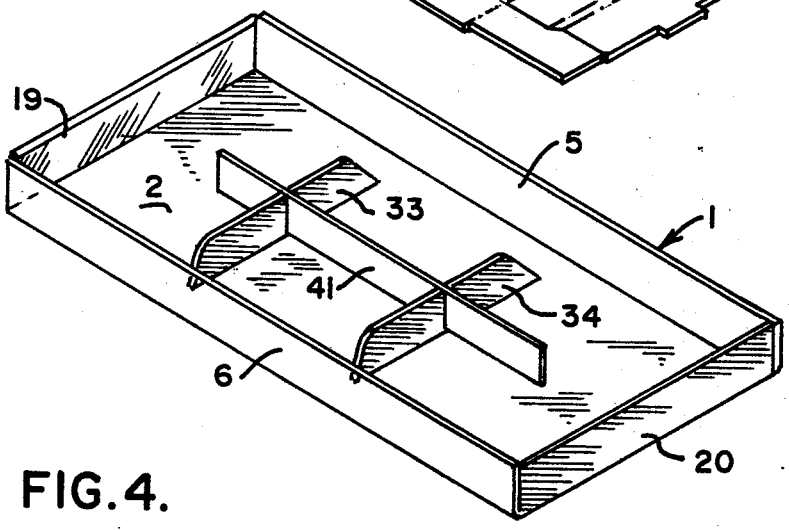
FIG. 4 furnishes an isometric view of the completely assembled tray of this invention.
Figure 5:
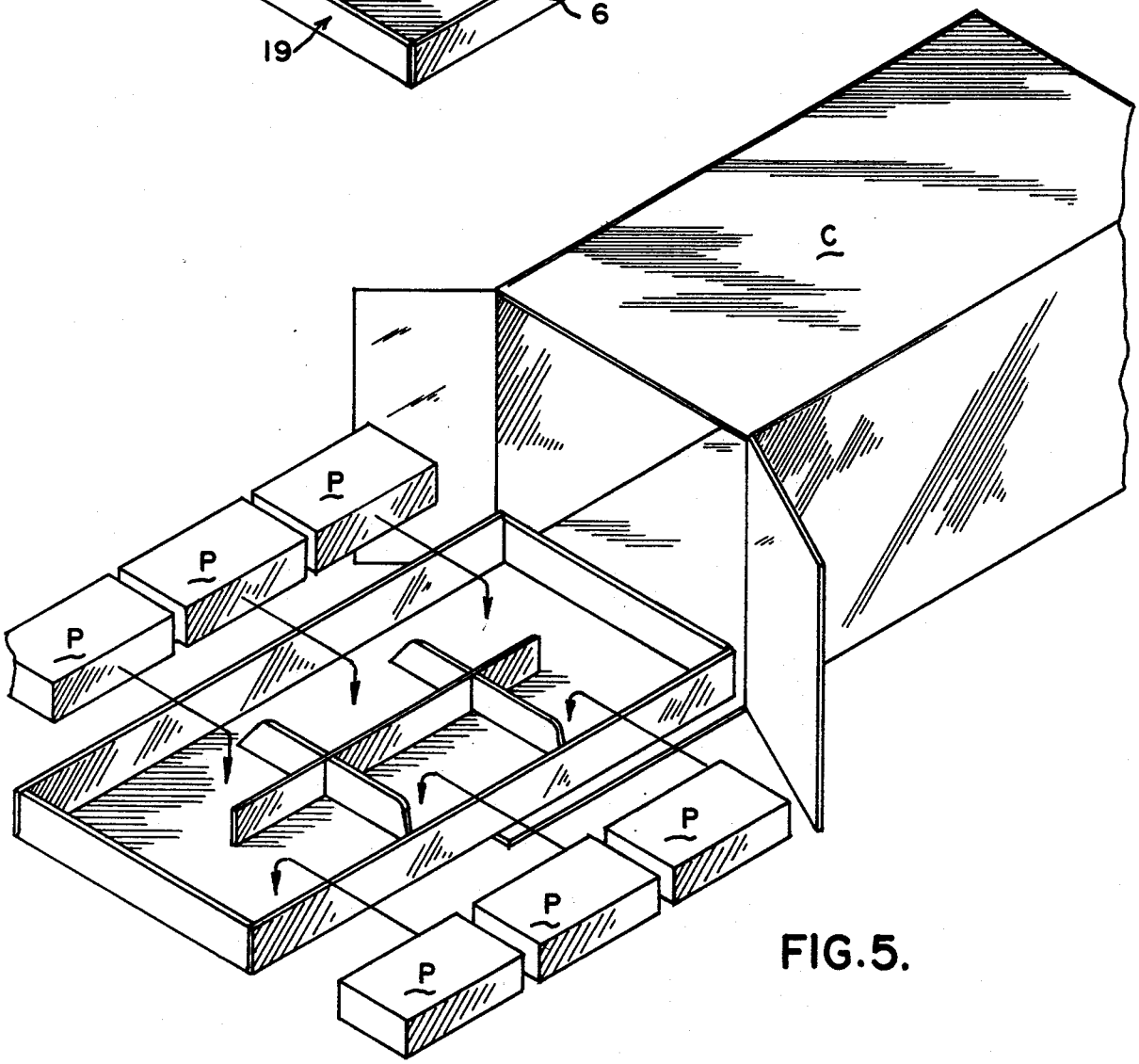
FIG. 5 discloses an assembled tray of this invention in preparation for receipt of packaged items, six as shown, as the tray is ready for insertion within a container for shipment.

The tray 1, when assembled, can be seen in fully in FIG. 4. As shown, the tray is formed having a bottom wall 2, the end walls 19 and 20, the side walls 5 and 6, the lateral partitions or dividers 33 and 34, and the longitudinal partition 41. When in this configuration, the tray is ready for usage, and can be loaded with a variety of packaged items, such as frozen foods, or other type products, which conveniently fit within the spaced areas formed within the tray interior. This can be more accurately seen in FIG. 5, wherein the packaged items P may be conveniently inserted within the various spaced areas of the tray, either manually, or automatically by machine, and then the trays may be slid interiorly of the container C. And, the container will have a width sufficient to provide for a snug insertion of the item laden tray 1 into its interior, and a plurality of these trays, when loaded, may also be slid interiorly of the container, the trays being stacked, one upon the other, so as to provide a convenient manner for shipping or storing a plurality of these packaged item laden trays to a distant location, as desired. In the preferred embodiment, as shown in FIG. 5, approximately four of the item laden trays 1 may be stacked one upon the other, and slid into the container C.

When the tray laden container C reaches its destination for usage, it may be opened, its trays removed, and the packaged items P, within their tray, may either be displayed for marketing from their tray, or the individually packaged items P may be removed from their trays, and located within a convenient display area for sale, such as within the frozen food display case of the supermarket.

Variations in the construction, assembly, fabrication, and usage of the multiple tray and container of this invention may occur to those skilled in the art upon reviewing the subject matter of this disclosure. Such variations, if within the spirit of the revealed invention, are intended to be encompassed by the scope of the claims appended hereto, and to be protected by any United States patent issuing thereon. The description of the preferred embodiment herein is meant for illustration purposes only, and not to be interpreted as limiting the scope of this invention.

Having thus described the invention what is claimed and desired to be secured by Letters Patent is:

1. A plurality of partitioned trays each for use in holding a variety of packaged items and being stackable for insertion and retention within an enclosing container, each tray having perpendicularly arranged fixed side walls, end walls, and a bottom wall, and having an opened top, each end wall being formed as a double panel, said double panel being hinged together at their formed upper ends, one panel of each said double panel foldably connecting to the end edges of the bottom wall, the other panel of each double panel having at least one extension for cooperating with means formed of the bottom wall for accommodating the said panel extension therein for facilitating the double panel erection, each side wall foldably connecting to a side edge of the bottom wall, a tab provided integrally extending from the ends of each said wide wall, said tabs provided for extension into and retention between their approximate double panel end wall for fixing the said walls into a tray configuration, each tab further including an extension on one side, with said extension provided for cooperating with the means formed in the bottom wall for retaining said side walls and their tabs into their folded position, a series of partitions disposed within each tray and extending upwardly for defining spaced areas for accommodating the positioning of said packaged items, and a container being of a size to snugly accommodate a plurality of said item laden stacked trays.

2. The invention of claim 1 wherein said series of partitions are arranged both laterally and longitudinally of their respective trays.

3. A partitioned tray for holding a variety of packaged items, each tray having perpendicularly arranged and rigid side walls, end walls, and a bottom wall, and having an opened top, each end wall being formed as a double panel, said double panel being hinged together along their upper edges, one panel of each double panel foldably connecting to the end edges of the bottom wall, the other panel of each double panel having means for cooperating with means formed in the bottom wall for retention of said double panel end walls into an erect configuration, each side wall foldably connecting to the side edges of the bottom wall, a tab provided integrally extending from the ends of each side wall, said tabs provided for extension into and retention between their proximate double panel end wall for fixing the said walls into a tray configuration, each tab including an extension on one side, said extension provided for cooperating with the means formed in the bottom wall for retaining said side walls and their tab into their erected position, and a series of partitions disposed within each tray and extending upwardly for defining spaced areas for positioning of the said packaged items therein.

4. The invention of claim 3 wherein said series of partitions are arranged both laterally and longitudinally of their respective tray.

5. The invention of claim 4 wherein at least the one partition arranged laterally of a tray being integrally formed from a partially cut out segment of the bottom wall.

6. The invention of claim 5 wherein the partition arranged longitudinally of a tray being interconnected with the laterally arranged partition.

7. The invention of claim 4 wherein a pair of partitions are arranged laterally of the tray, said partitions being integrally formed from partially cut out segments of the bottom wall.

8. The invention of claim 3 wherein said means formed in the bottom wall comprises slots.

9. A blank for a partitioned tray and for use when assembled for holding a variety of packaged items, said blank containing a bottom wall segment, end wall segments connecting to opposite ends of the bottom wall segment, side wall segments connecting to opposite side edges of the bottom wall segment, each end wall segment forming a double panel, one panel of each double panel foldably connecting to one end of the bottom wall segment, the other panel of each double panel having at least one extension and capable of cooperating with means formed in the bottom wall segment for accommodating the other panel extension therewith, a tab provided integrally and foldably extending from the ends of each side wall, said tabs capable of cooperating within the end wall segments for retention of the tray when assembled, at least one first partition partially cut from the blank bottom wall segment, and at least other partition removably secured to one of said end wall segments, said other partition capable of cooperating with the first said partition for defining spaced areas within an assembled tray.

10. The invention of claim 9 wherein there are a pair of said first partitions formed in the blank bottom wall, and said pair of partitions capable of forming a pair of lateral partitions within the assembled tray.

11. The invention of claim 10 and including there being at least one slot extending partially through the pair of first partitions and the other partition.

12. The invention of claim 11 and including there being an aperture formed in the bottom wall segment aligned with the ends of each first partition slot to facilitate the folding of said first partitions during tray assembly.

13. The invention of claim 9 and including a spacer segment arranged intermediate the double panels of each end wall segment, each spacer segment having a width approximating the thickness of each side wall tab.

14. The invention of claim 13 wherein the means formed in the bottom wall segment for accommodating the end wall segment extension comprising a slot.

15. The invention of claim 9 and including an extension from one side of each tab, each tab extension provided for inserting within a bottom wall slot for retaining each side wall tab into position when the tray is folded into its operative configuration.

* * * * *

UNITED STATES PATENT AND TRADEMARK OFFICE

CERTIFICATE OF CORRECTION

PATENT NO. : 4,111,353

DATED : September 5, 1978

INVENTOR(S) : Steven Collins, A. Wayne Fausett

It is certified that error appears in the above-identified patent and that said Letters Patent are hereby corrected as shown below:

In column 5, line 48, change "wide" to ---side---.

In column 6, line 50, change "other" to ---another---.

Signed and Sealed this

Sixth Day of March 1979

[SEAL]

*Attest:*

RUTH C. MASON
*Attesting Officer*

DONALD W. BANNER
*Commissioner of Patents and Trademarks*